United States Patent [19]

Taniguchi et al.

[11] Patent Number: 4,486,763

[45] Date of Patent: Dec. 4, 1984

[54] THERMOSENSITIVE RECORDING MATERIAL

[75] Inventors: Keishi Taniguchi; Susumu Iwata, both of Sunto; Hiroshi Sakamoto, Numazu, all of Japan

[73] Assignee: Ricoh Company, Ltd., Tokyo, Japan

[21] Appl. No.: 446,086

[22] Filed: Dec. 1, 1982

[30] Foreign Application Priority Data

Dec. 9, 1981 [JP] Japan ..... 56-197923

[51] Int. Cl.[3] ..... B41M 5/18

[52] U.S. Cl. ..... 346/209; 346/208; 346/217; 346/219; 346/221

[58] Field of Search ..... 282/27.5; 427/150–153; 428/320.4, 320.6, 320.8, 411, 488, 537, 913, 914

[56] References Cited

FOREIGN PATENT DOCUMENTS

| | | | |
|---|---|---|---|
| 53-11036 | 2/1978 | Japan | 346/209 |
| 56-69087 | 12/1981 | Japan | 346/209 |
| 57-67994 | 6/1982 | Japan | 346/209 |
| 57-87995 | 6/1982 | Japan | 346/209 |
| 57-96894 | 6/1982 | Japan | 346/209 |
| 57-102393 | 6/1982 | Japan | 346/209 |
| 57-103894 | 6/1982 | Japan | 346/209 |
| 57-117996 | 7/1982 | Japan | 346/209 |
| 57-123090 | 7/1982 | Japan | 346/209 |
| 57-123091 | 7/1982 | Japan | 346/209 |
| 57-135194 | 8/1982 | Japan | 346/209 |
| 57-126693 | 8/1982 | Japan | 346/209 |

*Primary Examiner*—Bruce H. Hess

*Attorney, Agent, or Firm*—Flynn, Thiel, Boutell & Tanis

[57] ABSTRACT

A thermosensitive recording material comprising a support member and thermosensitive layer formed on the support member, the thermosensitive layer comprising a fluoran compound represented by the formula (I), an acidic material capable of coloring the fluoran compound upon application of heat thereto, and a benzamide compound of the formula (II)

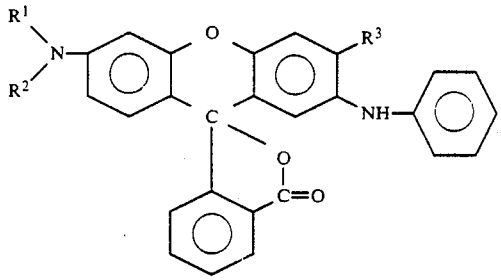

(I)

wherein $R^1$ represents an alkyl group with 5 to 8 carbon atoms, $R^2$ represents an alkyl group with 1 to 8 carbon atoms, and $R^3$ represents an alkyl group with 1 to 2 carbon atoms;

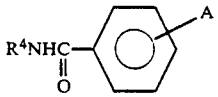

(II)

wherein $R^4$ represents an alkyl group with 10 to 30 carbon atoms, and A represents hydrogen or —$COOR^5$ in which $R^5$ represents an alkyl group with 1 to 10 carbon atoms.

7 Claims, No Drawings

THERMOSENSITIVE RECORDING MATERIAL

BACKGROUND OF THE INVENTION

The present invention relates to an improved thermosensitive recording material comprising a thermosensitive layer comprising a colorless or light-colored coloring compound and a developer capable of coloring the coloring compound by reacting therewith, upon application of heat thereto, and a support member for supporting the thermosensitive layer thereon, which thermosensitive recording material is improved so as to form a color with high density by application of a relatively small quantity of heat thereto, without the problems of discoloration by pressure or friction, and without deterioration during storage, and which does not contribute to the accumulation of dust on a thermal head during an image recording process by use of a thermal printer with a thermal head.

Conventionally, a thermosensitive recording material comprises a support member, for example, paper, synthesized paper or a resin film, and a thermosensitive layer formed thereon capable of forming a color upon application of heat thereto. For the application of heat, for example, a thermal printer with a thermal head is employed. In the thermosensitive layer, there are contained a colorless or light-colored leuco dye with a lactone ring, a lactam ring or a spiro-pyran ring as a coloring compound, and an acidic material as a developer for coloring the coloring compound by the reaction therewith, upon application of heat thereto.

As compared with other conventional recording materials, thermosensitive recording materials of the above-described type have advantages in that recording can be performed without requiring complicated steps such as development and image fixing; therefore, such recording is done speedily, quietly and at a low cost. Because of these advantages, there is a great demand for a thermosensitive recording material that is suitable for use in high speed recording, in particular, for use with computers, facsimile machines and a variety of measuring instruments.

For the above-mentioned objects, it is preferable that thermosensitive recording materials have the following properties:

(1) A color with high density in sharp contrast with the background can be formed by application of a relatively small quantity of energy thereto;

(2) There is no discoloration of the recording material by pressure or friction, whereby it is possible to obtain clear images with high image density;

(3) The recording material can be stored for a long period of time, without deterioration including fogging during the period of storage; and (4) The recording material does not substantially contribute to the accumulation of dust on a thermal head during an image recording process by use of a thermal printer with a thermal head, thereby attaining a smooth thermal recording operation, including scanning by the head over an extended period of time.

In an attempt to obtain a thermosensitive recording material with the above-described properties, there has been proposed a thermosensitive recording material which contains a fluoran compound of the following formula as a coloring compound; a conventional acidic material as a developer; and stearic acid amide as an auxiliary agent:

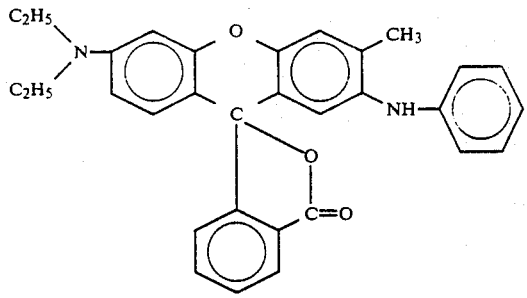

This conventional thermosensitive recording material yields, in fact, clearer images than other conventional thermosensitive recording materials do. However, it is not improved with respect to (i) the formation of a color with high image density such as can be employed for high speed recording process; (ii) discoloration by pressure or friction; (iii) deterioration, including fogging, during storage; and (iv) accumulation of dust on a thermal head during an image recording process when a thermal printer with a thermal head is employed.

SUMMARY OF THE INVENTION

It is therefore an object of the present invention to provide an improved thermosensitive recording material comprising a support member and a thermosensitive layer formed on the support member, which thermosensitive layer comprises a colorless or light colored fluoran compound as a coloring compound, an acidic material as a developer, and a benzamide compound as an auxiliary agent, which thermosensitive recording material is capable of forming a color with high density in sharp contrast with the background by application of a relatively small quantity of energy thereto, with increased thermosensitivity.

Another object of the present invention is to provide a thermosensitive recording material of the type described, in which discoloration by pressure or friction is prevented, making it possible to obtain clear images with high image density.

A further object of the present invention is to provide a thermosensitive recording material of the type described, which can be stored for a long period of time, without deterioration, including fogging, during storage.

A still further object of the present invention is to provide a thermosensitive recording material of the type described, which does not contribute substantially to the accumulation of dust on a thermal head during an image recording process by use of a thermal printer with a thermal head, thereby attaining a smooth thermal recording operation including scanning by the head over an extended period of time.

According to the present invention, in order to attain the above-mentioned objects, the thermosensitive layer formed on the support member comprises:

a fluoran compound of the formula (I) as a coloring compound

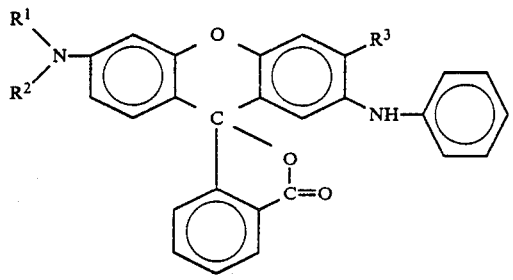

(I)

wherein $R^1$ represents an alkyl group with 5 to 8 carbon atoms, $R^2$ represents an alkyl group with 1 to 8 carbon atoms, and $R^3$ represents an alkyl group with 1 or 2 carbon atoms;

an acidic compound as a developer; and a benzamide compound of the formula (II) as an auxiliary agent

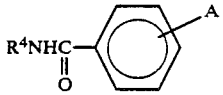

(II)

wherein $R^4$ represents an alkyl group with 10 to 30 carbon atoms, and A represents hydrogen or —$COOR^5$ in which $R^5$ represents an alkyl group with 1 to 10 carbon atoms.

DETAILED DESCRIPTION OF THE PREFERRED EMBODIMENTS

A thermosensitive recording material according to the present invention comprises a support member, and a thermosensitive layer formed on the support member, which thermosensitive layer contains:

a colorless or light-colored fluoran compound of the formula (I)

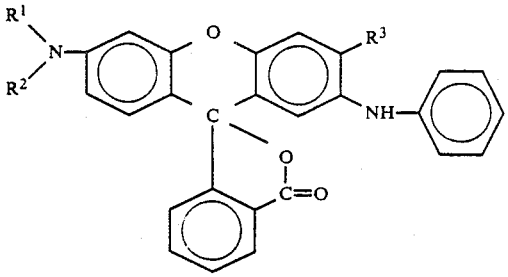

(I)

wherein $R^1$ represents an alkyl group with 5 to 8 carbon atoms, $R^2$ represents an alkyl group with 1 to 8 carbon atoms, and $R^3$ represents an alkyl group with 1 to 2 carbon atoms;

an acidic material capable of coloring the fluoran compound of the formula (I), upon application of heat hereto; and a benzamide compound of the formula (II)

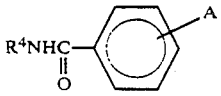

wherein $R^4$ represents an alkyl group with 10 to 30 carbon atoms, and A represents hydrogen or —$COOR^5$ in which $R^5$ represents an alkyl group with 1 to 10 carbon atoms.

By use of the above-described benzamide compound in combination with the above-described fluoran compound, features of the present invention, such as formation of a color with high density by application of a relatively small quantity of heat thereto, prevention of the discoloration by pressure or friction, long preservability without deterioration, and prevention of the accumulation of dust on a thermal head during an image recording process by use of a thermal printer with a thermal head, are attained. When the number of carbon atoms in the radical $R^4$ is less than 10, the preservability and sharpness in image are significantly decreased, while, when the number of carbon atoms in the radical $R^4$ is more than 30, the thermosensitivity decreases and the recording material is not suitable for high speed recording.

The amount of the benzamide compound of the formula (II) is in the range of 1 part by weight to 10 parts by weight thereof to 1 part by weight of the fluoran compound of the formula (I).

Specific examples of the fluoran compounds represented by the formula (I) for use in the present invention are listed in the following table 1:

TABLE 1

| Compound (I) | $R^1$ | $R^2$ | $R^3$ |
|---|---|---|---|
| (I)-1 | $-C_5H_{11}$ | $-CH_3$ | $-CH_3$ |
| (I)-2 | $-C_5H_{11}$ | $-C_2H_{511}$ | $-CH_3$ |
| (I)-3 | $-C_5H_{11}$ | $-C_8H_{17}$ | $-C_2H_5$ |
| (I)-4 | $-C_6H_{13}$ | $-CH_3$ | $-CH_3$ |
| (I)-5 | $-C_6H_{13}$ | $-C_8H_{17}$ | $-C_2H_5$ |
| (I)-6 | $-C_7H_{15}$ | $-CH_3$ | $-CH_3$ |
| (I)-7 | $-C_7H_{15}$ | $-C_8H_{17}$ | $-C_2H_5$ |
| (I)-8 | $-C_8H_{17}$ | $-C_8H_{17}$ | $-C_2H_5$ |

In the fluoran compounds of the formula (I), when the number of carbon atoms in the radical $R^1$ is less than 5, the melting point thereof exceeds 190° C. and is not preferable for use in the present invention, while, when the number of carbon atoms in the radical $R^1$ is more than 8, the melting point thereof is below 120° C. and is not preferable for use in the present invention. With respect to the radical $R^2$, it is preferable that the number of carbon atoms therein be not more than 8 from the view point of decreasing of the melting point of the compound (I).

Further, with respect to the radical $R^3$, it is preferable that the number of carbon atoms therein be 1 or 2. When the number of carbon atoms exceeds 2, the melting point of the compounds (I) is below 120° C. and is not preferable for use in the present invention.

Examples of acidic materials that can be employed as developers in the present invention are as follows:

Boric acid, oxalic acid, maleic acid, tartaric acid, citric acid, succinic acid, benzoic acid, stearic acid, gallic acid, salicylic acid, 1-hydroxy-2-naphthoic acid, o-hydroxybenzoic acid, m-hydroxybenzoic acid, 2-hydroxy-p-toluic acid, 3,5-xylenol, thymol, p-tert-butylphenol, 4-hydroxydiphenyloxide, methyl-4-hydroxybenzoate, 4-hydroxyacetophenone, α-naphthol, β-naphthol, catechol, resorcinol, hydroquinone, 4-tert-octylcatechol, 2,2'-dihydroxydiphenyl, 2,2'-methylenebis(4-methyl-6-tert-butylphenol), 2,2'-bis(4'-hydroxyphenyl)propane (or bisphenol A), 4,4'-isopropylidenebis(2-tert-butylphenol), 4,4'-sec-butylidenediphenol, pyrogallol, phloroglucinol, and phloroglucinol carboxylic acid.

Specific examles of benzamide compounds of the formula (II) for use in the present invention are listed in the following table 2:

TABLE 2

| Compound (II) | $R^4$ | A |
|---|---|---|
| (II)-1 | $-C_{10}H_{21}$ | H |
| (II)-2 | $-C_{11}H_{23}$ | H |
| (II)-3 | $-C_{12}H_{25}$ | H |
| (II)-4 | $-C_{18}H_{37}$ | H |
| (II)-5 | $-C_{18}H_{37}$ | $-COOCH_3$ |
| (II)-6 | $-C_{18}H_{37}$ | $-COOC_2H_5$ |
| (II)-7 | $-C_{18}H_{37}$ | $-COOC_{10}H_{21}$ |
| (II)-8 | $-C_{30}H_{61}$ | $-COOC_2H_5$ |

Among the benzamide compounds listed above, (II)-4 (i.e., N-stearylbenzamide), (II)-5 (i.e., N-stearyl-p-methoxycarbonylbenzamide) and (II)-6 (i.e., N-stearyl-p-ethoxycarbonylbenzamide) are particularly effective as auxiliary agents for use in the present invention.

In the thermosensitive layer of a thermosensitive recording material according to the present invention, the following binder agents can be employed:

Water-soluble organic polymers, such as polyvinyl alcohol, methyl cellulose, hydroxyethylcellulose, carboxymethylcellulose, polyvinylpyrrolidone, polyacrylamide, polyacrylic acid, starch, gelatin; and water emulsions of polystyrene, copolymer of vinyl chloride and vinyl acetate, and polybutylmethacrylate.

Furthermore, in the thermosensitive layer, the following additives can be contained in the form of fine powder to obtain clear images and to prevent formation of dust which may accumulate on a thermal head when a thermal printer with a thermal head is employed for image recording:

Calcium carbonate, silica, alumina, magnesia, talc, barium sulfate and alumium stearate, polystyrene, and urea-formaldehyde resin.

Embodiments of a thermosensitive recording material according to the present invention will now be described by the following examples.

EXAMPLE 1

A dispersion A-1 was prepared by mixing the following components in a ceramic ball mill for 2 days:

| | Parts by Weight |
|---|---|
| 3-methyl-n-amylamino-6-methyl-7-anilinofluoran (Compound (I)-1) (refer to Table 1) | 20 |
| Hydroxyethylcellulose (10% aqueous solution) | 20 |
| Water | 60 |

A dispersion B-1 was prepared by mixing the following components in a ceramic ball mill for 2 days:

| | Parts by Weight |
|---|---|
| 2,2'-bis(4'-hydroxyphenyl) propane | 20 |
| Hydroxyethylcellulose (10% aqueous solution) | 20 |
| Water | 60 |

A dispersion C-1 was prepared by mixing the following components in an attritor for 6 hours:

| | Parts by Weight |
|---|---|
| N—dodecylbenzamide (Compound(II)-3) (refer to Table 2) | 20 |
| Methyl cellulose (5% aqueous solution) | 60 |

One part by weight of the dispersion A-1, 4 parts by weight of the dispersion B-1, 2 parts by weight of the dispersion C-1, and 2 parts by weight of polyvinyl alcohol (20% aqueous solution) were mixed to prepare a thermosensitive coloring liquid for forming a thermosensitive layer. This thermosensitive coloring liquid was coated on the surface of a sheet of commercially available high quality paper (60 g/m$^2$) by a wire bar and then dried, whereby a thermosensitive layer was formed thereon. The deposition of the thermosensitive layer on the sheet was 60 g/m$^2$ in a dry state. Thus, a thermosensitive recording material No. 1 according to the present invention was prepared.

By use of the thus prepared thermosensitive recording material No. 1, thermal printing was performed by use of a commercially available facsimile apparatus (RIFAX-3300 made by Ricoh Company, Ltd.) with a thermal head in GIII mode.

As a result, a clear image with an image density of 1.20 (measured by a Macbeth reflection-type densitometer RD-514) was formed on the thermosensitive recording material.

In order to evaluate the extent of discoloration of the thermosensitive recording material No. 1 by pressure application or friction, pressure was manually applied to the non-image areas of the recording material by use of a metallic rod. The result was that coloring of the non-image areas, which in conventional thermosensitive recording materials may be caused by application of pressure thereto or friction thereagainst, was not observed at all.

Further, the thermosensitive recording material No. 1 was employed in the above-mentioned facsimile apparatus for 24 hours in order to evaluate the running performance of the thermosensitive recording material. The result was that no dust was observed on the thermal head after that period of operation, and equally clear images were obtained at the end of that test.

Furthermore, the thermosensitive recording material No. 1 was allowed to stand at 60° C. for 24 hours. No fogging occurred in the thermosensitive recording material, indicating that it can be stored without deterioration for a long period of time.

EXAMPLE 2

A dispersion A-2 was prepared by mixing the following components in a ceramic ball mill for 2 days:

| | Parts by Weight |
|---|---|
| 3-ethyl-n-amylamino-6-methyl-7-anilinofluoran (Compound (I)-2) (refer to Table 1) | 20 |
| Hydroxyethylcellulose (10% aqueous solution) | 20 |
| Water | 60 |

A dispersion B-2, which was the same as the dispersion B-1 employed in Example 1, was prepared in the same manner.

A dispersion C-2 was prepared by mixing the following components in an attritor for 6 hours:

| | Parts by Weight |
|---|---|
| N—stearylbenzamide (Compound (II)-4) (refer to Table 2) | 20 |
| Methyl cellulose (5% aqueous solution) | 60 |

One part by weight of the dispersion A-2, 4 parts by weight of the dispersion B-2, 2 parts by weight of the dispersion C-2, and 2 parts by weight of polyvinyl alcohol (20% aqueous solution) were mixed to prepare a thermosensitive coloring liquid for forming a thermosensitive layer. This thermosensitive coloring liquid was coated on the surface of a sheet of commercially available high quality paper (60 g/m$^2$) by a wire bar and then dried, whereby a thermosensitive layer was formed thereon. The deposition of the thermosensitive layer on the sheet was 6.0 g/m$^2$ in a dry state. Thus, a thermosensitive recording material No. 2 according to the present invention was prepared.

By use of the thus prepared thermosensitive recording material No. 2, thermal printing was performed by use of a commercially available facsimile apparatus (RIFAX-3300 made by Ricoh Company, Ltd.) with a thermal head in GIII mode.

As a result, a clear image with an image density of 1.30 (measured by a Macbeth reflection-type densitometer RD-514) was formed on the thermosensitive recording material.

The same pressure-application test as in Example 1 was performed with this thermosensitive recording material, and the results was that discoloration was not observed at all.

Further, the same running-performance test as in Example 1 was performed with this thermosensitive recording material, and the result was that no dust was observed on the thermal head after the period of operation, and equally clear images were obtained at the end of the test.

Furthermore, the thermosensitive recording material No. 2 was allowed to stand at 60° C. for 24 hours. No fogging occurred in the thermosensitive recording material, indicating that it can be stored without deterioration for a long period of time.

EXAMPLE 3

A dispersion A-3 was prepared by mixing the following components in a ceramic ball mill for 2 days:

| | Parts by Weight |
|---|---|
| 3-methyl-n-hexylamino-6-methyl-7-anilinofluoran (Compound (I)-4) (refer to Table 1) | 20 |
| Hydroxyethylcellulose (10% aqueous solution) | 20 |
| Water | 60 |

A dispersion B-3, which was the same as the dispersion B-1 employed in Example 1, was prepared in the same manner.

A dispersion C-3, which was the same as the dispersion C-2 employed in Example 2, was prepared in the same manner.

One part by weight of the dispersion A-3, 4 parts by weight of the dispersion B-3, 2 parts by weight of the dispersion C-3, and 2 parts by weight of polyvinyl alcohol (20% aqueous solution) were mixed to prepare a thermosensitive coloring liquid for forming a thermosensitive layer. This thermosensitive coloring liquid was coated on the surface of a sheet of commercially available high quality paper (60 g/m$^2$) by a wire bar and then dried, whereby a thermosensitive layer was formed thereon. The deposition of the thermosensitive layer on the sheet was 6.0 g/m$^2$ in a dry state. Thus, a thermosensitive recording material No. 3 according to the present invention was prepared.

By use of the thus prepared thermosensitive recording material No. 3, thermal printing was performed by use of a commercially available facsimile apparatus (RIFAX-3300 made by Ricoh Company, Ltd.) with a thermal head in GIII mode.

As a result, a clear image with an image density of 1.27 (measured by a Macbeth reflection-type densitometer RD-514) was formed on the thermosensitive recording material.

The same pressure-application test as in Example 1 was performed with this thermosensitive recording material, and the result was that discoloration was not observed at all.

Further, the same running-performance test as in Example 1 was performed with this thermosensitive recording material, and the result was that no dust was observed on the thermal head after the period of operation, and equally clear images were obtained at the end of the test.

Furthermore, the thermosensitive recording material No. 3 was allowed to stand at 60° C. for 24 hours. No fogging occurred in the thermosensitive recording material, indicating that it can be stored without deterioration for a long period of time.

EXAMPLE 4

A dispersion A-4, which was the same as the dispersion A-3 employed in Example 3, was prepared in the same manner.

A dispersion B-4, which was the same as the dispersion B-1 employed in Example 1, was prepared in the same manner.

A dispersion C-4 was prepared by mixing the following components in an attritor for 6 hours:

| | Parts by Weight |
|---|---|
| p-methoxycarbonyl-N—stearylbenzamide (Compound (II)-5) (refer to Table 2) | 20 |
| Methyl cellulose (5% aqueous solution) | 60 |

One part by weight of the dispersion A-4, 4 parts by weight of the dispersion B-4, 2 parts by weight of the dispersion C-4, and 2 parts by weight of polyvinyl alcohol (20% aqueous solution) were mixed to prepare a thermosensitive coloring liquid for forming a thermosensitive layer. This thermosensitive coloring liquid was coated on the surface of a sheet of commercially available high quality paper (60 g/m$^2$) by a wire bar and then dried, whereby a thermosensitive layer was formed thereon. The deposition of the thermosensitive layer on the sheet was 6.0 g/m$^2$ in a dry state. Thus, a thermosensitive recording material No. 4 according to the present invention was prepared.

By use of the thus prepared thermosensitive recording material No. 4, thermal printing was performed by use of a commercially available facsimile apparatus (RIFAX-3300 made by Ricoh Company, Ltd.) with a thermal head in GIII mode.

As a result, a clear image with an image density of 1.14 (measured by a Macbeth reflection-type densitometer RD-514) was formed on the thermosensitive recording material.

The same pressure-application test as in Example 1 was performed with this thermosensitive recording material, and the result was that discoloration was not observed at all.

Further, the same running-performance test as in Example 1 was performed with this thermosensitive recording material, and the result was that no dust was observed on the thermal head after the period of operation, and equally clear images were obtained at the end of the test.

Furthermore, the thermosensitive recording material No. 4 was allowed to stand at 60° C. for 24 hours. No fogging occurred in the thermosensitive recording material, indicating that it can be stored without deterioration for a long period of time.

EXAMPLE 5.

A dispersion A-5, which was the same as the dispersion A-2 employed in Example 2, was prepared in the same manner.

A dispersion B-5, which was the same as the dispersion B-1 employed in Example 1, was prepared in the same manner.

A dispersion C-5, which was the same as the dispersion C-4 employed in Example 4, was prepared in the same manner.

One part by weight of the dispersion A-5, 4 parts by weight of the dispersion B-5, 2 parts by weight of the dispersion C-5, and 2 parts by weight of polyvinyl alcohol (20% aqueous solution) were mixed to prepare a thermosensitive coloring liquid for forming a thermosensitive layer. This thermosensitive coloring liquid was coated on the surface of a sheet of commercially available high quality paper (60 g/m$^2$) by a wire bar and then dried, whereby a thermosensitive layer was formed thereon. The deposition of the thermosensitive layer on the sheet was 6.0 g/m$^2$ in a dry state. Thus, a thermosensitive recording material No. 5 according to the present invention was prepared.

By use of the thus prepared thermosensitive recording material No. 5, thermal printing was performed by use of a commercially available facsimile apparatus (RIFAX-3300 made by Ricoh Company, Ltd.) with a thermal head in GIII mode.

As a result, a clear image with an image density of 1.18 (measured by a Macbeth reflection-type densitometer RD-514) was formed on the thermosensitive recording material.

The same pressure-application test as in Example 1 was performed with this thermosensitive recording material, and the result was that discoloration was not observed at all.

Further, the same running-performance test as in Example 1 was performed with this thermosensitive recording material, and the result was that no dust was observed on the thermal head after the period of operation, and equally clear images were obtained at the end of the test.

Furthermore, the thermosensitive recording material No. 5 was allowed to stand at 60° C. for 24 hours. No fogging occurred in the thermosensitive recording material, indicating that it can be stored without deterioration for a long period of time.

EXAMPLE 6

A dispersion A-6 was prepared by mixing the following components in a ceramic ball mill for 2 days:

| | Parts by Weight |
|---|---|
| 3-n-octyl-n-octylamino-6-ethyl-7-anilinofluoran (Compound (I)-8) (refer to Table 1) | 20 |
| Hydroxyethylcellulose (10% aqueous solution) | 20 |
| Water | 60 |

A dispersion B-6, which was the same as the dispersion B-1 employed in Example 1, was prepared in the same manner.

A dispersion C-6 was prepared by mixing the following components in an attritor for 6 hours:

| | Parts by Weight |
|---|---|
| p-ethoxycarbonyl-N—stearylbenzamide (Compound (II)-6) (refer to Table 2) | 20 |
| Methyl cellulose (5% aqueous solution) | 60 |

One part by weight of the dispersion A-6, 4 parts by weight of the dispersion B-6, 2 parts by weight of the dispersion C-6, and 2 parts by weight of polyvinyl alcohol (20% aqueous solution) were mixed to prepare a thermosensitive coloring liquid for forming a thermosensitive layer. This thermosensitive coloring liquid was coated on the surface of a sheet of commercially available high quality paper (60 g/m$^2$) by a wire bar and then dried, whereby a thermosensitive layer was formed thereon. The deposition of the thermosensitive layer on the sheet was 6.0 g/m$^2$ in a dry state. Thus, a thermosensitive recording material No. 6 according to the present invention was prepared.

By use of the thus prepared thermosensitive recording material No. 6, thermal printing was performed by use of a commercially available facsimile apparatus (RIFAX-3300 made by Ricoh Company, Ltd.) with a thermal head in GIII mode.

As a result, a clear image with an image density of 1.17 (measured by a Macbeth reflection-type densitometer RD-514) was formed on the thermosensitive recording material.

The same pressure-application test as in Example 1 was performed with this thermosensitive recording material, and the result was that discoloration was not observed at all.

Further, the same running-performance test as in Example 1 was performed with this thermosensitive recording material, and the result was that no dust was observed on the thermal head after the period of operation, and equally clear images were obtained at the end of the test.

Furthermore, the thermosensitive recording material No. 6 was allowed to stand at 60° C. for 24 hours. No fogging occurred in the thermosensitive recording material, indicating that it can be stored without deterioration for a long period of time.

EXAMPLE 7

A dispersion A-7 was prepared by mixing the following components in a ceramic ball mill for 2 days:

| | Parts by Weight |
|---|---|
| 3-methyl-n-heptylamino-6-methyl-7-anilinofluoran (Compound (I)-6) (refer to Table 1) | 20 |
| Hydroxyethylcellulose (10% aqueous solution | 20 |
| Water | 60 |

A dispersion B-7, which was the same as the dispersion B-1 employed in Example 1, was prepared in the same manner.

A dispersion C-7 was prepared by mixing the following component in an attritor for 6 hours:

| | Parts by Weight |
|---|---|
| p-decanyloxycarbonyl-N—stearylbenzamide (Compound(II)-7) (refer to Table 2) | 20 |
| Methyl cellulose (5% aqueous solution) | 60 |

One part by weight of the dispersion A-7, 4 parts by weight of the dispersion B-7, 2 parts by weight of the dispersion C-7, and 2 parts by weight of polyvinyl alcohol (20% aqueous solution) were mixed to prepare a thermosensitive coloring liquid for forming a thermosensitive layer. This thermosensitive coloring liquid was coated on the surface of a sheet of commercially available high quality paper (60 g/m$^2$) by a wire bar and then dried, whereby a thermosensitive layer was formed thereon. The deposition of the thermosensitive layer on the sheet was 6.0 g/m$^2$ in a dry state. Thus, a thermosensitive recording material No. 7 according to the present invention was prepared.

By use of the thus prepared thermosensitive recording material No. 7, thermal printing was performed by use of a commercially available facsimile apparatus (RIFAX-3300 made by Ricoh Company, Ltd.) with a thermal head in GIII mode.

As a result, a clear image with an image density of 1.19 (measured by a Macbeth reflection-type densitometer RD-514) was formed on the thermosensitive recording material.

The same pressure-application test as in Example 1 was performed with this thermosensitive recording material, and the result was that discoloration was not observed at all.

Further, the same running-performance test as in Example 1 was performed with this thermosensitive recording material, and the result was that no dust was observed on the thermal head after the period of operation, and equally clear images were obtained at the end of the test.

Furthermore, the thermosensitive recording material No. 7 was allowed to stand at 60° C. for 24 hours. No fogging occurred in the thermosensitive recording material, indicating that it can be stored without deterioration for a long period of time.

EXAMPLE 8

A dispersion A-8, which was the same as the dispersion A-3, employed in Example 3 was prepared in the same manner.

A dispersion B-8, which was the same as the dispersion B-1 employed in Example 1, was prepared in the same manner.

A dispersion C-8 was prepared by mixing the following components in an attritor for 6 hours:

| | Parts by Weight |
|---|---|
| p-ethoxycarbonyl-N—triacotanylbenzamide (Compound(II)-8; (refer to Table 2) | 20 |
| Methyl cellulose (5% aqueous solution) | 60 |

One part by weight of the dispersion A-8, 4 parts by weight of the dispersion B-8, 2 parts by weight of the dispersion C-8, and 2 parts by weight of polyvinyl alcohol (20% aqueous solution) were mixed to prepare a thermosensitive coloring liquid for forming a thermosensitive layer. This thermosensitive coloring liquid was coated on the surface of a sheet of commercially available high quality paper (60 g/m$^2$) by a wire bar and then dried, whereby a thermosensitive layer was formed thereon. The deposition of the thermosensitive layer on the sheet was 6.0 g/m$^2$ in a dry state. Thus, a thermosensitive recording material No. 8 according to the present invention was prepared.

By use of the thus prepared thermosensitive recording material No. 8, thermal printing was performed by use of a commercially available facsimile apparatus (RIFAX-3300 made by Ricoh Company, Ltd.) with a thermal head in GIII mode.

As a result, a clear image with an image density of 1.20 (measured by a Macbeth reflection-type densitometer RD-514) was formed on the thermosensitive recording material.

The same pressure-application test as in Example 1 was performed with this thermosensitive recording material, and the result was that discoloration was not observed at all.

Further, the same running-performance test as in Example 1 was performed with this thermosensitive recording material, and the result was that no dust was observed on the thermal head after the period of operation, and equally clear images were obtained at the end of the test.

Furthermore, the thermosensitive recording material No. 8 was allowed to stand at 60° C. for 24 hours. No fogging occurred in the thermosensitive recording material, indicating that it can be stored without deterioration for a long period of time.

COMPARATIVE EXAMPLE 1

Example 3 was repeated except that the dispersion A-3 was replaced by a dispersion CA-1 which was prepared by mixing the following components in a ceramic ball mill for 2 days, whereby a comparative thermosensitive recording material No. 1 was prepared:

| | Parts by Weight |
|---|---|
| 3-diethylamino-6-methyl-7-anilinofluoran | 20 |
| Hydroxyethylcellulose (10% aqueous | 20 |

-continued

| | Parts by Weight |
|---|---|
| solution) | |
| Water | 60 |

By use of the thus prepared comparative thermosensitive recording material No. 1, thermal printing was performed by use of the facsimile apparatus (RIFAX-3300 made by Ricoh Company, Ltd.) with a thermal head in GIII mode.

The result was that images formed were not clear and the image density thereof was 1.05 by a Macbeth reflection-type densitometer RD-514.

In repeating the previously described test, coloring of the non-image areas was caused by application of pressure thereto and friction thereagainst.

Further, when the comparative thermosensitive recording material No. 1 was employed in the above-mentioned facsimile apparatus for 24 hours in order to evaluate the running performance, the result was that appreciable dust was observed on the thermal head after the period of operation.

Furthermore, when the comparative thermosensitive recording material No. 1 was allowed to stand at 60° C. for 24 hours, fogging occurred in the thermosensitive recording material, indicating that it cannot be stored without deterioration for a long period of time.

COMPARATIVE EXAMPLE 2

Example 4 was repeated except that the dispersion A-4 was replaced by a dispersion CA-2, which was the same as the dispersion CA-1 employed in Comparative Example 1, prepared in the same manner, whereby a comparative thermosensitive recording material No. 2 was prepared.

By use of the thus prepared comparative thermosensitive recording material No. 2, thermal printing was performed by use of the facsimile apparatus (RIFAX-3300 made by Ricoh Company, Ltd.) with a thermal head in GIII mode.

The result was that images formed were not clear and the image density thereof was 0.98 by a Macbeth reflection-type densitometer RD-514.

In repeating the previously described test, coloring of the non-image areas was caused by application of pressure thereto and friction thereagainst.

Further, when the comparative thermosensitive recording material No. 2 was employed in the above-mentioned facsimile apparatus for 24 hours in order to evaluate the running performance, the result was that appreciable dust was observed on the thermal head after the period of operation.

Furthermore, when the comparative thermosensitive recording material No. 2 was allowed to stand at 60° C. for 24 hours, fogging occurred in the thermosensitive recording material, indicating that it cannot be stored without deterioration for a long period of time.

COMPARATIVE EXAMPLE 3

Example 3 was repeated except that the dispersion C-3 was replaced by a dispersion CC-1 which was prepared by mixing the following components in an attritor for 6 hours, whereby a comparative thermosensitive recording material No. 3 was prepared:

| | Parts by Weight |
|---|---|
| Stearamide | 20 |
| Methyl cellulose (5% aqueous solution) | 60 |

By use of the thus prepared comparative thermosensitive recording material No. 3, thermal printing was performed by use of the facsimile apparatus (RIFAX-3300 made by Ricoh Company, Ltd.) with a thermal head in GIII mode.

The result was that images formed were not clear and the image density thereof was 1.05 by a Macbeth reflection-type densitometer RD-514.

In repeating the previously described test, coloring of the non-image areas were caused by application of pressure thereto and friction thereagainst.

Further, when the comparative thermosensitive recording material No. 3 was employed in the above-mentioned facsimile apparatus for 24 hours in order to evaluate the running performance, the result was that appreciable dust was observed on the thermal head after that long operation.

Furthermore, when the comparative thermosensitive recording material No. 3 was allowed to stand at 60° C. for 24 hours, fogging occurred in the thermosensitive recording material, indicating that it cannot be stored without deterioration for a long period of time.

What is claimed is:

1. A thermosensitive recording material comprising a support member and a thermosensitive layer formed on said support member, said thermosensitive layer comprising a fluoran compound of the formula (I), an acidic material capable of coloring said fluoran compound upon application of heat thereto, and a benzamide compound of the formula (II)

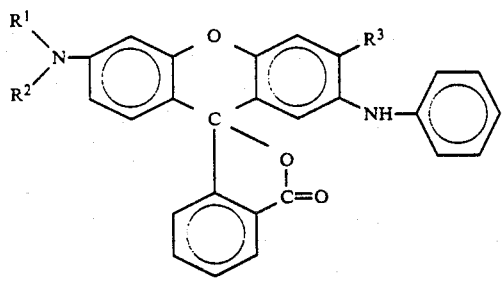

(I)

wherein $R^1$ represents an alkyl group with 5 to 8 carbon atoms, $R^2$ represents an alkyl group with 1 or 8 carbon atoms, and $R^3$ represents an alkyl group with 1 to 2 carbon atoms;

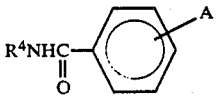

(II)

wherein $R^4$ represents an alkyl group with 10 to 30 carbon atoms, and A represents hydrogen or —$COOR^5$ in which $R^5$ represents an alkyl group with 1 to 10 carbon atoms.

2. A thermosensitive recording material as claimed in claim 1, wherein the amount of said benzamide compound contained in said thermosensitive layer is in the range of 1.0 to 10.0 parts by weight with respect to one part by weight of said fluoran compound.

3. A thermosensitive recording material an claimed in claim 1, wherein said benzamide compound is selected from the group consisting of N-stearylbenzamide, N-stearyl-p-methoxycarbonylbenzamide, and N-stearyl-p-ethoxycarbonylbenzamide.

4. A thermosensitive recording material as claimed in claim 1, wherein said acidic material is an acid which is selected from the group consisting of boric acid, oxalic acid, maleic acid, tartaric acid, citric acid, succinic acid, benzoic acid, stearic acid, gallic acid, salicylic acid, 1-hydroxy-2-naphthoic acid, o-hydroxybenzoic acid, m-hydroxybenzoic acid and 2-hydroxy-p-toluic acid.

5. A thermosensitive recording material as claimed in claim 1, wherein said acidic material is a phenolic material which is selected from the group consisting of 3,5-xylenol, thymol, p-tert-butyl-phenol, 4-hydroxydiphenyloxide, methyl-4-hydroxybenzoate, 4-hydroxyacetophenone, α-naphthol, β-naphthol, catechol, resorcinol, hydroquinone, 4-tert-octylcatechol, 2,2'-dihydroxydiphenyl, 2,2'-methylenebis(4-methyl-6-tert-butylphenol), 2,2'-bis(4-hydroxyphenyl)-propane, 4,4'-isopropylidenebis(2-tert-butylphenol), 4,4'-sec-butylidenediphenol, pyrogallol, phloroglucinol and phloroglucinol carboxylic acid.

6. A thermosensitive recording material as claimed in claim 1, wherein said thermosensitive layer further comprises a binder agent selected from the group consisting of water-soluble organic polymers and water emulsions of polystyrene, copolymer of vinyl chloride and vinyl acetate, or polybutylmethacrylate.

7. A thermosensitive recording material as claimed in claim 1, wherein said thermosensitive layer further comprises an additive for improvement of image quality, which additive is selected from the group consisting of calcium carbonate, silica, alumina, magnesia, talc, barium sulfate, aluminum stearate, polystyrene, and ureaformaldehyde resin.

* * * * *

UNITED STATES PATENT AND TRADEMARK OFFICE

CERTIFICATE OF CORRECTION

PATENT NO. : 4 486 763

DATED : December 4, 1984

INVENTOR(S) : Keishi TANIGUCHI et al

It is certified that error appears in the above-identified patent and that said Letters Patent is hereby corrected as shown below:

Column 14, line 52; change "1 or 8" to ---1 to 8---.
line 53; change "1 to 2" to ---1 or 2---.

Signed and Sealed this

*First* Day of *October 1985*

[SEAL]

*Attest:*

DONALD J. QUIGG

*Attesting Officer*

*Commissioner of Patents and Trademarks—Designate*